United States Patent [19]

Ripoll

[11] Patent Number: 4,573,662

[45] Date of Patent: Mar. 4, 1986

[54] HYDRAULIC JACK FOR STRESSING ELONGATE ELEMENTS

[75] Inventor: Javier G. Ripoll, Madrid, Spain

[73] Assignee: Stronghold International AG, Liechtenstein, England

[21] Appl. No.: 596,277

[22] Filed: Apr. 3, 1984

[51] Int. Cl.[4] ..... E21B 19/00

[52] U.S. Cl. ..... 254/29 A

[58] Field of Search ..... 254/29 A; 29/452; 81/57.38

[56] References Cited

U.S. PATENT DOCUMENTS

| | | | |
|---|---|---|---|
| 3,658,296 | 4/1972 | Yegge | 254/29 A |
| 3,844,023 | 10/1974 | Surribas et al. | 29/452 |
| 4,405,114 | 9/1983 | Macchi | 254/29 A |

FOREIGN PATENT DOCUMENTS

| | | |
|---|---|---|
| 1143641 | 2/1969 | United Kingdom . |
| 1151708 | 5/1969 | United Kingdom . |
| 1212309 | 11/1970 | United Kingdom . |
| 1375203 | 11/1974 | United Kingdom . |
| 1402655 | 8/1975 | United Kingdom . |
| 1520677 | 8/1978 | United Kingdom . |
| 1527601 | 10/1978 | United Kingdom . |

*Primary Examiner*—Robert C. Watson

*Attorney, Agent, or Firm*—Cushman, Darby and Cushman

[57] ABSTRACT

A hydraulic jack with an unlocking plate which moves with the clamping plate and which has its own separate actuating structure. Therefore the unlocking plate can be actuated to release the clamping wedges in any position of the clamping plate. Preferably the actuating structure is a piston-and-cylinder arrangement which can be removed rearwardly from the jack without breaking any seals. The clamping plate may be spaced from the lock-off plate even in its forwardmost position. The front end of the jack may be provided by legs, allowing access between the lock-off plate and the clamping plate. Alternatively a cage of element-guiding sleeves may be provided between the lock-off plate and the clamping plate to guide the elements during threading. The clamping plate may be arranged to be removable from the jack rearwardly.

11 Claims, 3 Drawing Figures

HYDRAULIC JACK FOR STRESSING ELONGATE ELEMENTS

BACKGROUND OF THE INVENTION

1. Field of the Invention

This invention relates to a hydraulic jack for use in simultaneously stressing a plurality of elongate elements e.g. concrete reinforcing elements, or other steel cables which need precise tensioning, in the form of wire or strand 2. Description of the Prior Art In recent years there have come into use hydraulic jacks which are capable of stressing simultaneously a large number of individual reinforcing elements, for instance as many as 150. The elements may each be for instance an individual wire or strand (i.e. a plurality of individual wires twisted together) or a group of wires not twisted together. Usually, such jacks have a gripping plate having a bore for each element which provides a conical seat for split conical gripping wedges which grip the element while the gripping plate is moved rearwardly, to stress the elements simultaneously.

After stressing, the elements are anchored in an anchoring plate which abuts the end concrete structure or is a part of the mould. Before stressing, split conical anchoring wedges are arranged in the conical seats in the bores in the anchoring plate through which the ends of the elements project. Conventionally, the type of jack described above has a lock-off piston (also called an anchoring piston) which is actuated after stressing to cause the anchoring wedges to be urged into their seats to grip the elements. It is usual to provide a lock-off plate which is driven forward by the lock-off piston so as to engage and drive home the anchoring wedges. The lock-off plate can be made removable from the jack, and it can then be used as a template to assist in the insertion of the elements into the jack before stressing.

After the anchoring wedges are secure, the jack must be released from the elements. One way of doing this is to provide a plate which is located in front of the gripping plate and has bores through which the elements pass and sleeves which surround the elements and extend from these bores into the bores in the gripping plate. Movement of the unlocking plates towards the gripping plate causes the sleeves to engage the gripping wedges to cause unlocking of the gripping wedges. The jack can then be removed from the elements. In known jacks, this unlocking action of the unlocking plate is performed only when the jack is closed up (i.e. the gripping plate is moved again to the front of the jack), following a stressing operation. In effect, in this closing up, since the gripping wedges are still secured to the elements, the body of the jack moves backwards away from the anchoring plate, and eventually an abutment in the front end of the jack strikes the unlocking plate to cause unlocking.

Examples of known jacks are illustrated in GB No. 1,402,655 and GB No. 1,527,601.

In many prior art jacks the gripping plate is located close to the front of the jack when it is closed up, and the plate is removable through the front of the jack (the gripping and unlocking plates must have an arrangement of apertures corresponding to the arrangement of elements, and so need to be changed to suit different arrangements).

However, it has been proposed in UK No. 1,449,320 to locate the gripping plate at the back of the jack. This proposed construction includes a movable part which acts as the lock-off plate. This part is not removed to act as a template in the insertion of the elements into the jack, but rather the jack is threaded with this part in situ. In order to guide the elements so that they approach the clamping plate properly located, this movable part is in the form of a cage or frame through which elements are threaded. This part extends the entire length of the jack and may also act as the unclamping means, protrusions on its rear end effecting unclamping as the jack closes up.

It has now been realised that certain improvements in aspects of these jacks are possible.

SUMMARY OF THE INVENTION

According to the invention, there is provided a hydraulic jack for use in simultaneously stressing a plurality of elongate elements, having a body with a front end and a hydraulically driven tensioning member including clamping means for the elements and movable away from the front end to pull the reinforcing elements so as to stress them, there being unclamping means for said clamping means which are operable at any position of the tensioning member. The unclamping means may take the form of an unlocking plate carrying unclamping wedges e.g. as described above in relation to known jacks. The unclamping means may be operable by mechanical or hydraulic means which are mounted for movement with the tensioning member. The actuating means may be located in front of the clamping plate, e.g. adjacent the unlocking plate, but, if the actuating means are hydraulically operated, it is preferable that they are mounted rearwardly of the clamping plate and connected to the unlocking plate in a suitable manner e.g. by a connection passing through the clamping plate.

The actuating means may be a hydraulic piston-and-cylinder unit mounted on the tensioning member. The movable part of the piston-and-cylinder unit may be guided by a guide tube bearing on an inner surface of the tensioning member. Suitably the piston-and-cylinder unit is removable from the tensioning member as a unit, without breaking of hydraulic seals.

The clamping plate may be spaced from the front of the jack, and advantageously it and the unlocking plate (or other unclamping means) are removable through the rear of the jack. In some situations it may be more convenient to remove these parts from the rear than from the front as in a conventional jack. In such an embodiment it may be desirable to have a cage or guide for the elements to guide them within the front part of the jack from the lock-off plate to the clamping plate and unclamping means. Thus in a preferred construction the parts are arranged in order from the front of the jack to the back as follows: lock-off plate; cage; unlocking plate; clamping plate; and hydraulic actuating means for the unlocking plate.

In another construction the said front end may be provided by a plurality (preferably two only) of legs which are laterally spaced so as to allow access to the region in front of the tensioning member. Preferably two such legs are provided, e.g. in the form of parallel plates, allowing access from two opposite sides.

In the spaces between the legs to which access is thus easily provided, the anchoring plate and lock-off plate are for example located by means for positioning and moving these plates which can be provided separately from the jack. Thus a jack of greatly simplified construction can be provided, and the method of operation can be made easier and more flexible. Threading of the elements into the clamping means of the tensioning member may also be greatly simplified.

DESCRIPTION OF THE DRAWINGS

Embodiments of the present invention will now be described by way of example with reference to the accompanying drawings, in which.

DESCRIPTION OF THE PREFERRED EMBODIMENTS

Figure 1:
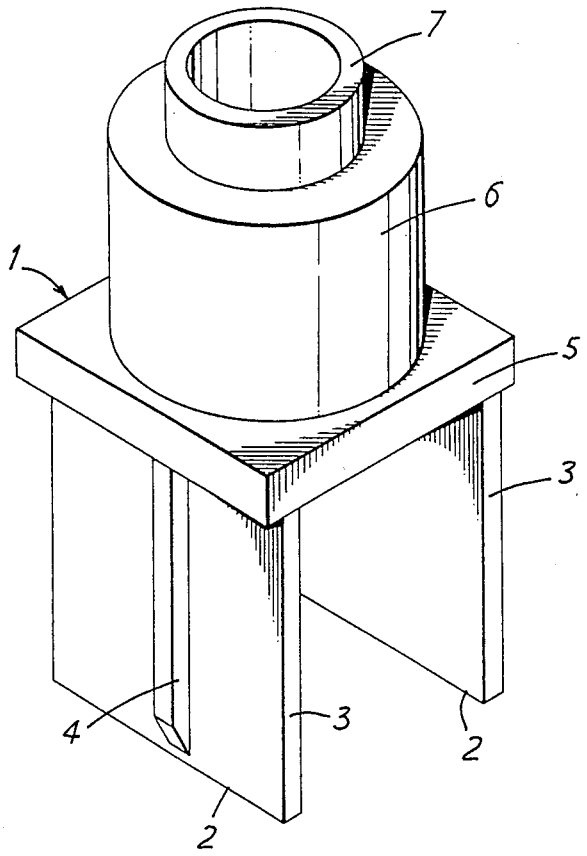
FIG. 1 is a schematic perspective view of the exterior of a jack embodying the present invention.

Referring first to FIG. 1, the jack embodying the invention has a body 1 having a front end 2 provided by two legs 3 in the form of parallel plates having exterior reinforcing flanges 4. At their ends remote from the front end 2, the plates 3 and flanges 4 are welded to a thicker transverse plate 5 to form a bridge-like structure. This is detachably connected to the cylindrical part 6 of the body which contains the main hydraulic stressing piston-and-cylinder unit. The movable piston 7 of this unit is shown partly extended out of the back of the cylindrical part 6. FIG. 1 shows how the arrangement of legs in the form of spaced parallel plates 3 and the plate 5 allows good access from two opposite sides to the region in front of the main stressing cylinder.

Figure 2:
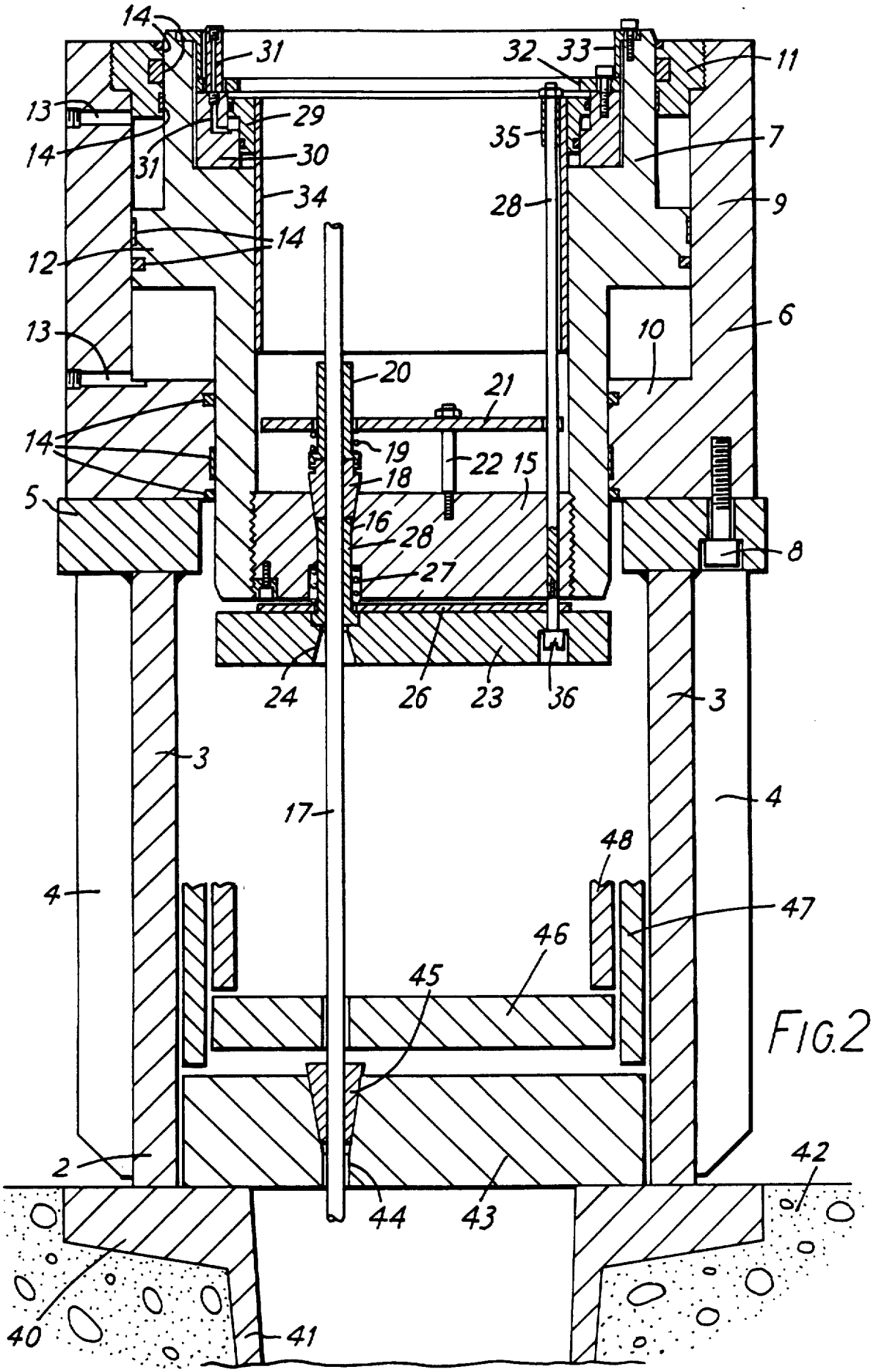
FIG. 2 is an axial longitudinal section of the jack of FIG. 1.

FIG. 2 shows the jack in more detail, particularly the piston-and-cylinder unit 6. This unit is attached to the plate 5 by bolts 8 and comprises an outer cylinder 9 having at its front end an interior flange 10 and at its rear end a removable ring 11 forming an interior flange. Sliding within the cylinder 9 is the main stressing piston 7 which has an exterior flange 12 which provides a face opposed to the flange 10 to define the annular volume for the pressurized hydraulic fluid to effect stressing. The rear face of the flange 12 provides a surface opposed to the front surface of the ring 11, to define a further annular space for pressurized hydraulic fluid to retract the piston 7. Passages 13 in the cylinder 9 provide access to these volumes, and seals 14 are provided to seal them.

At its front end, the piston 9 has a tensioning member comprising a clamping plate 15 screw-threadedly received in it. The plate 15 has a plurality of bores 16 which receive the respective elongate elements 17 to be stressed. Only one such element and one such bore are shown in FIG. 2 for convenience, but in practice a large number, even as many as 120, may be present. Each bore 16 has an upper conical portion receiving a split annular conical wedge 18 which is urged into the bore 16 by a spring 19 mounted around a sleeve 20 passing through a plate 21 held at a fixed distance behind the clamping plate 15 by bolts 22. This is a conventional automatic clamping arrangement.

To unlock the clamping wedge 18 when required, an unlocking plate 23 is mounted in front of the clamping plate 15, and has bores 24 corresponding in position to the bores 16. The lower ends of the bores 24 flare, and in their upper ends are located the flanged lower ends of the unlocking sleeves 25 which extend away from the unlocking plate 23 into the bores 16. A plate 26 traps the sleeves 25 and provides one abutment surface for a compression spring 27 which is located in an enlarged diameter portion of the bore 16 around the sleeve 25.

The unlocking plate 23 is moved rearwardly relative to the clamping plate 15, in order to effect unclamping of the wedges 18, by an unlocking piston 29 which with a cylinder 30 forms a further hydraulic piston-and-cylinder unit mounted on and moving with the main piston 7. Opposed flanges on the piston 29 and cylinder 30 provide an annular volume for pressurized hydraulic fluid, to which a passage 31 leads. A ring 32 bolted to the cylinder 30 limits rearward movement of the piston 29 and is itself trapped in the piston 7 by a ring 33 which is bolted to the piston 7.

At its interior surface, the piston 29 carries a ring or sleeve 34 which extends forwardly contacting the inner surface of the piston 7 so as to act as a guide to ensure correct aligned movement of the piston 29. At a plurality of points around its inner periphery, the sleeve 34 has sleeves 35 attached to it through which pass rods 28. The rods 28 extend forwardly through the plates 21 and 15 and are attached at their lower ends to bolts 36 whose heads are lodged in recesses in the lower face of the unlocking plate 23. The maximum distance of the unlocking plate 23 from the piston 29 is thus fixed.

To effect unlocking of the wedges 18, the piston 29 is moved rearwardly relative to the piston 7, by pressurized hydraulic fluid. The rods 28, through the bolts 36, pull the unlocking plate 23 towards the clamping plate 15, against the springs 27. The sleeves 25 engage and push the wedges 18 upwardly. This operation can be effected at any position of the main stressing piston 7, in contrast with previously known arrangements where unlocking was only possible with the main piston-and-cylinder in its fully closed position. The unlocking of the wedges 18 can be effected at will using the piston-and-cylinder unit 29,30 which also enables threading of the element 17 into the clamping plate 15 to take place at any position of the main piston 7. The piston-and-cylinder unit 29,30 can be removed as a whole from the jack, by releasing the rods 28 and the ring 33, without breaking any hydraulic seals.

FIG. 2 also shows the front end 2 of the jack abutting the flange 40 of a sleeve 41 which defines the bore for the stressing element 17 in a preformed concrete body 42. Within and adjacent the legs 3 of the jack, and also abutting the flange 40, is the anchoring plate 43 containing part-conical bores 44 which receive the anchoring wedges 45 for the element 17. Rearwardly of this is shown the lock-off plate 46. Schematically indicated are sleeves 47,48 for respectively moving the anchoring plate and the lock-off plate 46 forwardly. The anchoring plate 43 is moved forward prior to locking off the anchoring wedges 45 in order to ensure its correct position against the flange 40. Thereafter the lock-off plate 46 is moved forwardly to force the anchoring wedges 45 into the bores 44 to anchor the stressing element 17 after the main piston and cylinder unit 7,9 has been used to effect a tensioning operation. Means for moving the sleeves 47,48 are not shown, but may be provided entirely separately of the jack embodying the invention. The arrangement of the legs 3 allows access for ancillary equipment for this purpose. Alternatively, the sleeves 47,48 may be driven by hydraulic piston-and-cylinder units mounted on the jack shown in the drawings.

Figure 3:
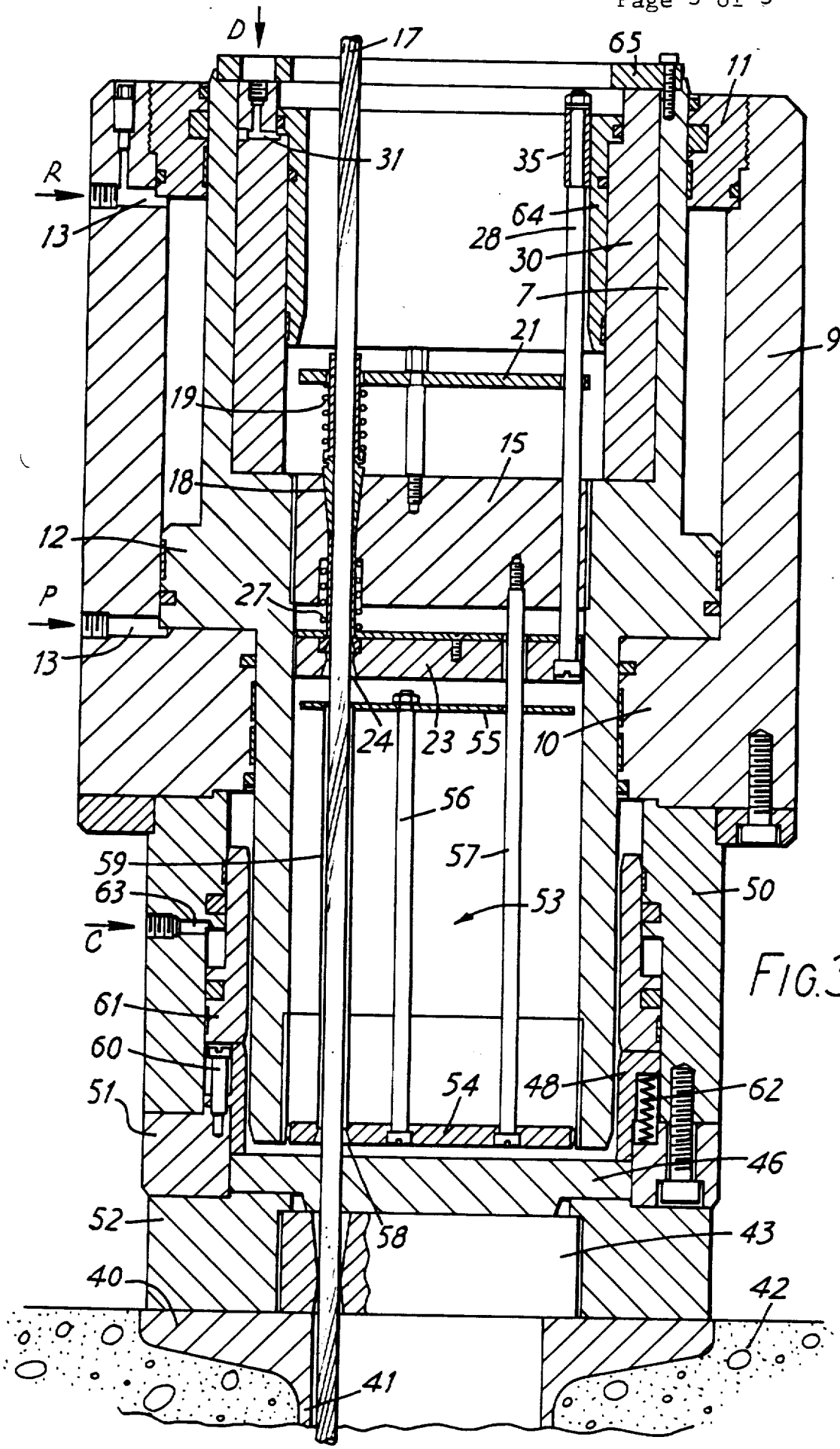
FIG. 3 is an axial longitudinal section of a second jack embodying the present invention.

FIG. 3 is a view corresponding to FIG. 2 of a second jack embodying the present invention. This second jack is similar to the first in much of its structure, especially at its rear end, and its major features have been identified on the drawing with the same reference numerals as are used in FIGS. 1 and 2 for analogous parts. These features will not be described again. In contrast to FIG. 2, in FIG. 3 the main cylinder and the unlocking cylinder are both shown fully closed up.

One major difference between the jacks of FIGS. 2 and 3 is that the jack of FIG. 3 has no legs 3 at its front end. Instead, the cylinder 9 is continued forward by a cylindrical piece 50. At its front end, this piece 50 is bolted to an end ring 51, and the jack rests with its end ring 51 on a supporting ring 52 which surrounds the anchor plate 43 and holds it in place.

In this embodiment the clamping plate 15 is spaced from the lock-off plate 46 and the front of the jack, even when the jack is closed up. In order to assist with the threading of the elements 17, a cage or guide piece 53 extends between the clamping plate 15 and the lock-off plate 46. The cage 53 has a front plate 54 and a rear plate 55 held together by bolts 56. Further bolts 57 extend from the front plate 54 through the rear plate 55 and the unlocking plate 23 to the clamping plate 15, so that the cage 53 moves rearwardly with the clamping plate 15 and the main piston 7 as the elements 17 are stressed. The main piston 7 extends forwardly around the cage 53 to the level of the front plate 54.

During threading of the elements 17, they pass from the lock-off plate 46 into flared holes 58 in the front plate 54. From the holes 58 the elements 17 pass into sleeves 59 which extend between the two plates 54,55 of the cage 53. At the rear end of the cage 53 the elements 17 pass through the rear plate 55 and are delivered, still correctly aligned, into the flaredbores 24 of the unlocking plate 23.

At the front end of the jack, the anchor plate 43 is held in place by the jack supporting block 52, as stated above. Consequently there is no sleeve to move it as in FIG. 2. On the other hand, a sleeve 48 is provided to move the lock-off plate 46, and FIG. 3 shows a hydraulically powered drive for it.

The sleeve 48 is slidably mounted on bolts 60 extending from the rear surface of the front end ring 51. It is biased away from the ring 51 and towards a piston 61 by springs 62. The cylindrical piece 50 acts as the cylinder for this piston 61, and a passage 63 is provided for hydraulic fluid to drive the piston 61 forwards, moving the sleeve 48 and the locking-off plate 46 against the bias of the springs 62. In FIG. 3 the piston 61 is shown partially extended pressing the lock-off plate 46 against the anchor plate 43.

Another important difference between the jacks of FIGS. 2 and 3 is that in FIG. 3 the main core of the jack: the cage 53, the unlocking plate 23, the clamping plate 15 and the plate 21 for automatic clamping action, can all be removed rearwardly from the piston 7, rather than forwardly as in FIG. 2. The lock-off plate 46 remains removable forwardly, which is desirable since it is sometimes used as a template for threading the elements 17.

At the rear of the jack of FIG. 3, a simplified construction is shown for the unlocking piston and cylinder. The unlocking piston 29 and the guiding sleeve 34 are combined in a single piece 64. A single rear end ring 65 combines the functions of the previous rings 32 and 33, being bolted to the piston 7 and extending over the end of the unlocking cylinder 30 to hold it in place, and also extending past the unlocking cylinders 30 to limit rearward movement of the piece 64.

Lastly, FIG. 3 shows the four hydraulic inlets to the jack labelled C, D, P and R. Pressurising inlet C drives forward the piston 61 for the lock-off plate 46. The piston is returned by the springs 62. Pressurising inlet D drives rearwardly the piece 64 to effect unlocking movement of the unlocking plate 23. The piece 64 is returned by the springs 19, 27 of the automatic clamping arrangement and of the unlocking plate 23. Pressurising inlet P drives the main stressing piston 7 rearwardly, to stress the elements 17. It is returned by pressuring inlet R.

What is claimed is:

1. A hydraulic jack for use in stressing simultaneously a plurality of elongate elements, the jack comprising:

a body with a front end;

a hydraulically driven tensioning member, including clamping means for the elements and movable away from the said front end to pull the elongate elements so as to stress them;

hydraulic means for driving the tensioning member; and unclamping means operable to release the said clamping means, the unclamping means being operable in any position of the tensioning member within the range of its said movement and including an unlocking plate located in front of the tensioning member and movable with the tensioning member during its said movement, the unlocking plate being moved towards the tensioning member to provide the said unclamping.

2. A jack as defined in claim 1 in which the tensioning member is spaced behind the front end of the jack even at the forwardmost position within the range of its said movement, and in which the jack is provided with means to guide the said elongate elements over at least a part of the distance between the front end of the jack and the tensioning member during threading of the elements through the jack.

3. A jack as defined in claim 2 in which the said guide means is fixed to and moves with the tensioning member.

4. A jack as defined in claim 2 in which the said guide means comprises a plurality of sleeves, one for each element, extending between two plates spaced in the direction of stressing movement of the tensioning member.

5. A jack as defined in claim 1 in which the said front end of the body is provided by a plurality of legs spaced from one another so as to allow access to the region in front of the tensioning member.

6. A jack as defined in claim 5 having only two said legs, the legs being in the form of opposed parallel axially extending plates.

7. A jack as defined in claim 5 in which a first portion of the jack body comprising at least the said legs is separable from a second portion of the jack body having the said hydraulic means for driving the said tensioning member.

8. A jack as defined in claim 1 in which the unlocking plate is moved towards the tensioning member by a hydraulic piston-and-cylinder arrangement.

9. A jack as defined in claim 8 in which the said piston-and cylinder arrangement of the unlocking plate is located to the rear of the tensioning member, and moves with the tensioning member during the said movement of the tensioning member.

10. A jack as defined in claim 9 in which the said piston-and-cylinder arrangement of the unlocking plate is removable rearwardly from the jack, and can be so removed without breaking any hydraulic seals.

11. A jack as defined in claim 1 in which the tensioning member can be removed rearwardly from the jack.

* * * * *

UNITED STATES PATENT AND TRADEMARK OFFICE

CERTIFICATE OF CORRECTION

PATENT NO. : 4,573,662

DATED : March 4, 1986

INVENTOR(S) : Javier G. Ripoll

It is certified that error appears in the above-identified patent and that said Letters Patent is hereby corrected as shown below:

Insert Figures 2 and 3 as part of Letters Patent as shown on the attached sheets.

Signed and Sealed this

Twenty-sixth Day of September, 1989

*Attest:*

DONALD J. QUIGG

*Attesting Officer*

*Commissioner of Patents and Trademarks*